US005253562A

United States Patent [19]

Kline

[11] Patent Number: 5,253,562

[45] Date of Patent: Oct. 19, 1993

[54] DOUBLE PLECTRUM HAVING A SPACER FILLED WITH COMPRESSIBLE FLUID

[76] Inventor: Marvin L. Kline, I-1 Oaklane Gardens, Trexlertown, Pa. 18087

[21] Appl. No.: 924,760

[22] Filed: Aug. 4, 1992

[51] Int. Cl.[5] ..... G10D 3/16

[52] U.S. Cl. ..... 84/322; D17/20

[58] Field of Search ..... 84/322, 321, 320; D17/20

[56] References Cited

U.S. PATENT DOCUMENTS

| | | | |
|---|---|---|---|
| 753,534 | 3/1904 | Barnes | 84/322 |
| 768,241 | 8/1904 | Seidel | 84/322 |
| 3,442,169 | 5/1969 | Bowers | 84/322 |
| 4,228,719 | 10/1980 | Keene | 84/322 |
| 4,248,128 | 2/1981 | Des Gaines | 84/322 |
| 4,651,614 | 3/1987 | Cavallo | 84/322 |

*Primary Examiner*—Michael L. Gellner
*Assistant Examiner*—Cassandra Spyrou
*Attorney, Agent, or Firm*—Leon Gilden

[57] ABSTRACT

A double plectrum is provided having respective first and second body plates arranged coextensively relative to one another, having a spacer filled with compressible fluid replaceably mounted therebetween to permit varying of spacing between the first and second body plates during use of the organization in striking a stringed instrument.

2 Claims, 4 Drawing Sheets

DOUBLE PLECTRUM HAVING A SPACER FILLED WITH COMPRESSIBLE FLUID

BACKGROUND OF THE INVENTION

1. Field of the Invention

The use of a plectrum for the striking of a stringed instrument is known, wherein the item is typically positioned between an individual's forefinger and thumb in the striking of an associated string member of a stringed instrument. The organization of the invention includes a double plectrum structure to permit the striking of more of a stringed instrument string member to effect production of a more complex audible note than available in the use of a single plectrum member.

2. Description of the Prior Art

Prior art has utilized both conventional and plural plectrum striking members. A single plectrum configuration is exemplified in the U.S. Pat. Nos. 4,843,942 and 4,497,237. The U.S. Pat. Nos. 4,651,614 to Cavallo and 4,398,444 to Walker indicate the use of a plectrum having a plurality of projections mounted relative to a single base, with the projections extending therefrom for striking a stringed instrument.

As such, it may be appreciated there continues to be a need for a new and improved double plectrum as set forth by the instant invention which addresses both the problems of ease of use as well as effectiveness in construction in providing for the adjustable spacing of a first striking projection relative to a further striking projection and in this respect, the present invention substantially fulfills this need.

SUMMARY OF THE INVENTION

In view of the foregoing disadvantages inherent in the known types of guitar pick structure now present in the prior art, the present invention provides a double plectrum wherein the same utilizes adjustably mounted plate bodies to vary distances of striking projections relative to the plectrum construction. As such, the general purpose of the present invention, which will be described subsequently in greater detail, is to provide a new and improved double plectrum which has all the advantages of the prior art double plectrum organizations and none of the disadvantages.

To attain this, the present invention provides a double plectrum having respective first and second plates arranged coextensively relative to one another, having a spacer replaceably mounted therebetween to permit varying of spacing between the first and second body plates during use of the organization in striking a stringed instrument.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved double plectrum which has all the advantages of the prior art double plectrum organizations and none of the disadvantages.

It is another object of the present invention to provide a new and improved double plectrum which may be easily and efficiently manufactured and marketed.

It is a further object of the present invention to provide a new and improved double plectrum which is of a durable and reliable construction.

An even further object of the present invention is to provide a new and improved double plectrum which is susceptible of a low cost of manufacture with regard to both materials and labor, and which accordingly is then susceptible of low prices of sale to the consuming public, thereby making such double plectrums economically available to the buying public.

Still yet another object of the present invention is to provide a new and improved double plectrum which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
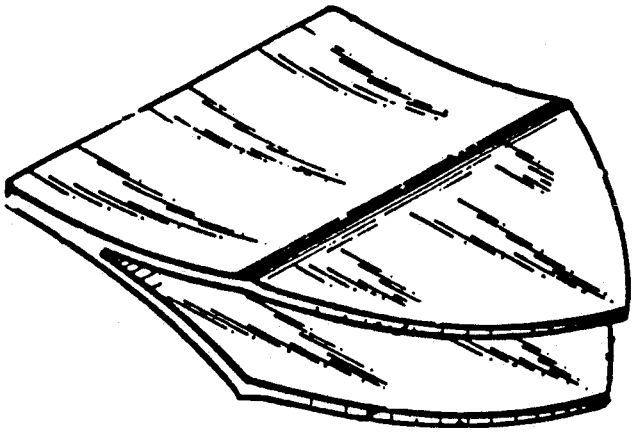
FIG 1 PRIOR ART
FIG. 1 is an isometric illustration of a double plectrum structure mounted to a single base, as indicated in U.S. Pat. No. 4,651,614.
Figure 2:
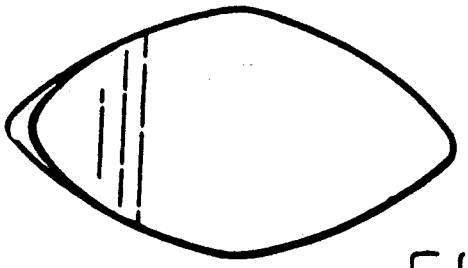
FIG 2 PRIOR ART
FIG. 2 is an orthographic top view of a double plectrum structure mounted to a single base, as indicated in U.S. Pat. No. 4,398,444.
Figure 3:
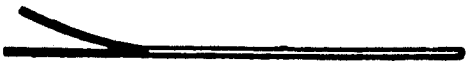
FIG 3 PRIOR ART
FIG. 3 is an orthographic side view of the double plectrum structure, as set forth in FIG. 2.

With reference now to the drawings, and in particular to FIGS. 1 to 9 thereof, a new and improved double plectrum embodying the principles and concepts of the present invention and generally designated by the reference numeral 10 will be described.

Figure 4:
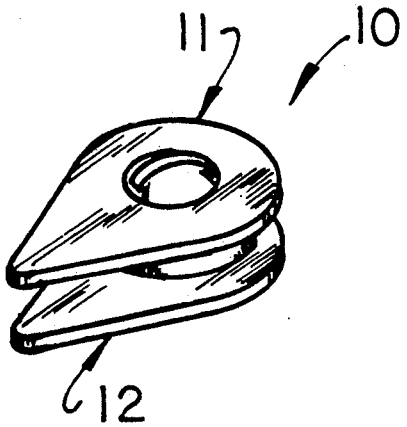
FIG. 4 is an isometric illustration of the instant invention.
Figure 5:
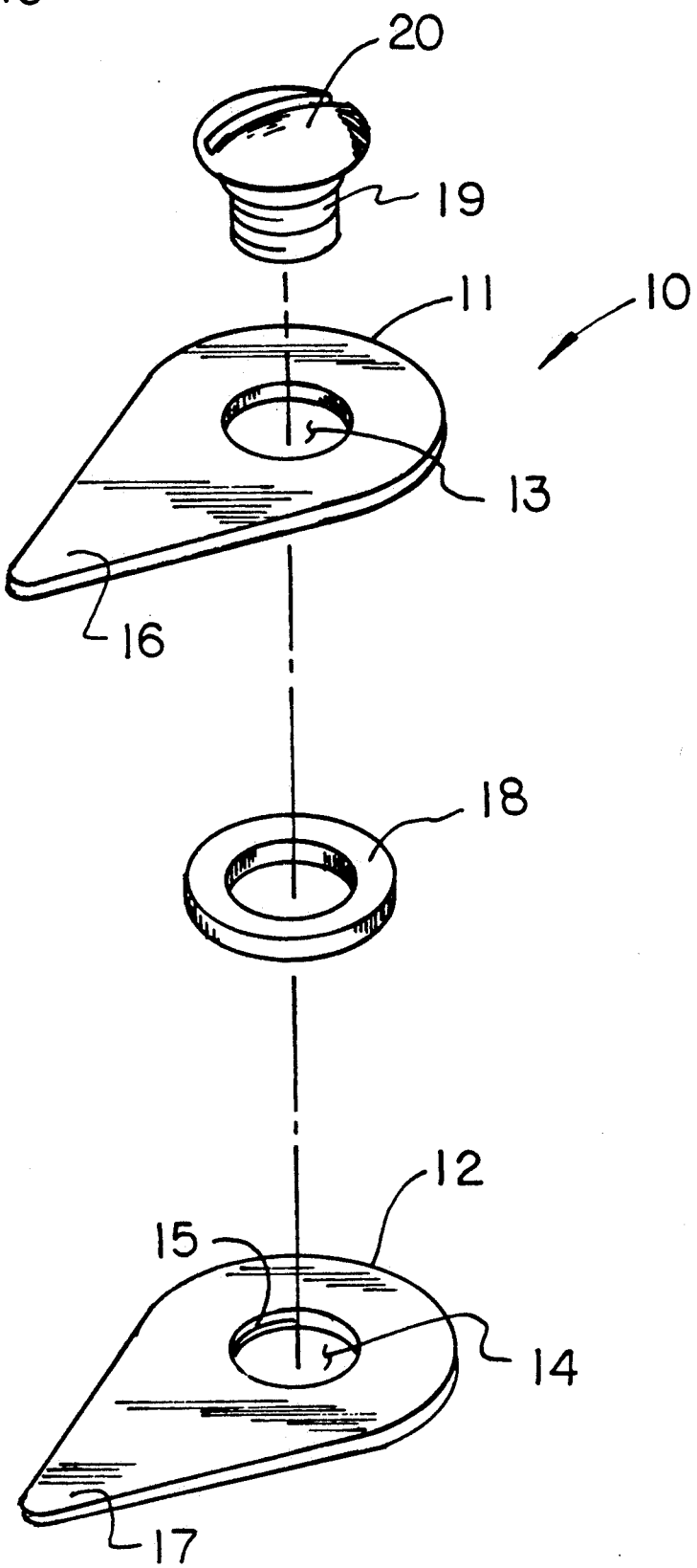
FIG. 5 is an isometric illustration of the invention in an exploded view.
Figure 7:
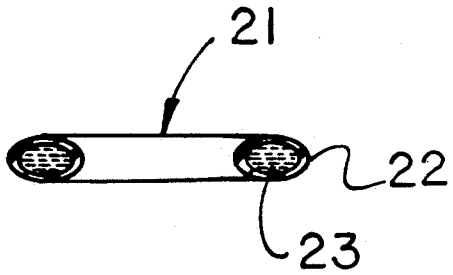
FIG. 7 is an orthographic view, taken along the lines 7—7 of FIG. 6 in the direction indicated by the arrows.

More specifically, the double plectrum 10 of the instant invention essentially comprises a first plate body 11 spaced from and coextensive relative to a second plate body 12, with the first plate body and the second plate body 11 and 12 respectively having first and second body bores 13 and 14 respectively directed medially of the first and second plate bodies. The first plate body bore 13 is of a generally smooth configuration to receive a threaded fastener body 19 therethrough, with the second body bore 14 having an internally threaded second bore wall 15 for threaded interengagement with the threaded fastener body 19. The fastener body 19 includes a fastener head 20 extending laterally beyond the first body bore 13 to secure the first and second plate bodies 11 and 12 together. A spacer ring 18 is interposed between the first and second plate bodies 11 and 12 receiving the fastener body 19 therethrough to space the first and second plate bodies in a spatial relationship, as indicated in FIG. 4. The first plate body 11 includes a first body striking projection 16, with the second plate body 12 having a second body striking projection 17 directed from the respective first and second plate bodies 11 and 12. The spatial relationship of the striking projections 16 and 17 permit for the effecting of complex audible vibrations from stringed instruments not availed by the single plectrum and more importantly, the ease of disassembly of the first plate body 11 relative to the second plate body 12 to interpose spacer rings 18 of various thicknesses to provide for the spacing of the first body striking projection 16 relative to the second body striking projection 17 to permit personalized adjustment in the striking of audible notes relative to a stringed instrument by such spacing.

Figure 6:
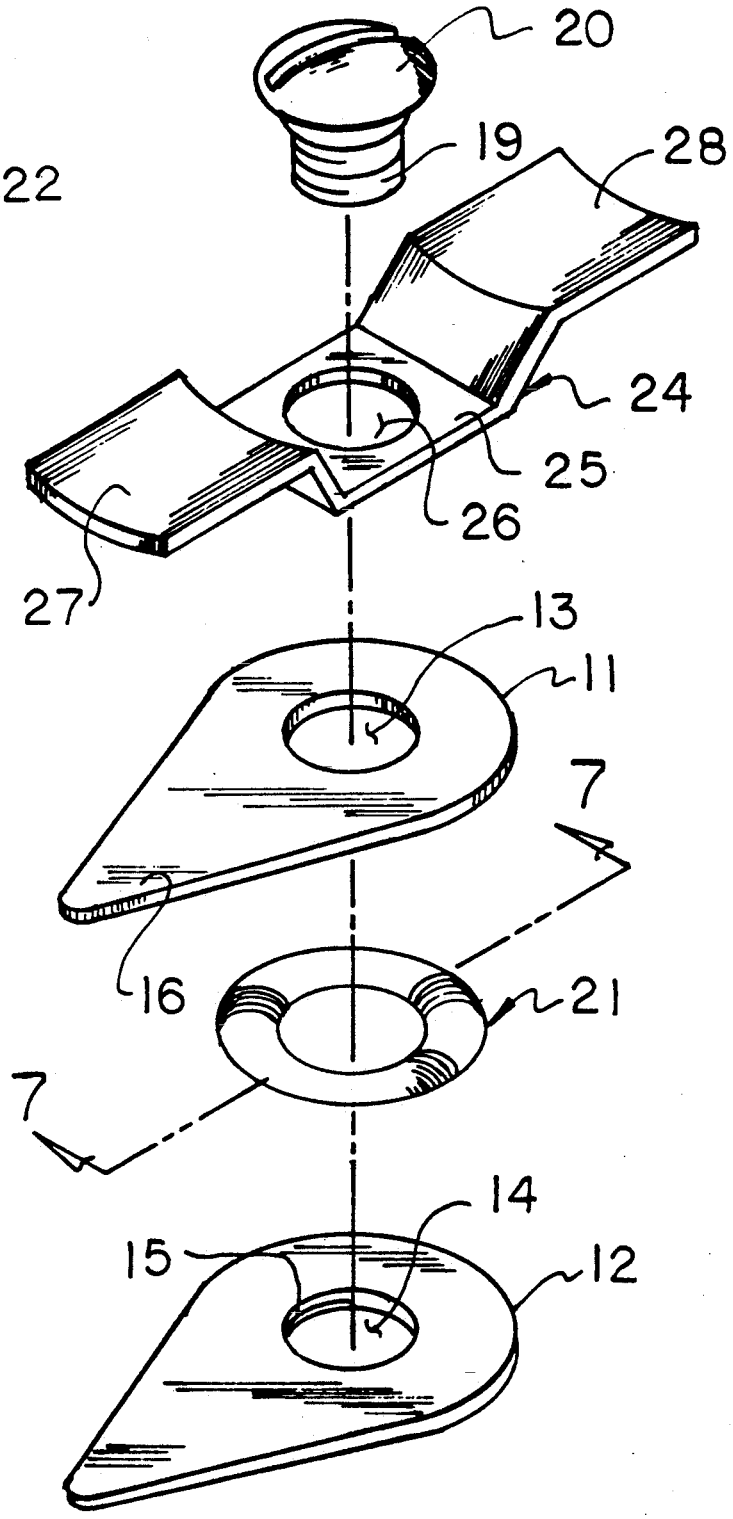
FIG. 6 is an isometric illustration of the invention employing an adjusting means for the first and second plate members of the double plectrum.
Figure 9:
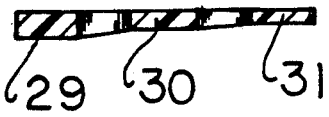
FIG. 9 is an orthographic view, taken along the lines 9—9 of FIG. 8 in the direction indicated by the arrows.

The FIG. 6 of the invention indicates the organization to further include a torroidal ring 21 having a resilient sheath torroidal tube 22 having a torroidal cavity therewithin containing a fluid 23 coextensively therethrough. The resilient sheath torroidal tube 22 is interposed between the first and second plate bodies 11 and 12 in lieu of the spacer ring 18. A lever plate 24 is provided having a central web 25, with the central web bore 26 directed medially therethrough to receive the fastener body 19, with the central web 25 to overlie in contiguous relationship the first plate body 11. A forward lever flange 27 and a rear lever flange 28 are diametrically aligned on opposed sides of the central web bore 26 and are colinear relative to one another and spaced above the central web 25. The forward lever flange 27 is positioned overlying the first and second body striking projections 16 and 17, with the rear lever flange 28 positioned to overlie the first and second body plates 11 and 12 in a diametrically aligned relationship relative to the forward lever flange 27. In this manner, adjustable spacing of the first and second body striking projections 16 and 17 is afforded by the manual deflection of the forward or rear lever flanges 27 and 28 forwardly or rearwardly of the projections 16 and 17 to thereby permit resilient compression of the resilient sheath torroidal tube 22 permitting the first and second body plates 11 and 12 to pivot somewhat about the threaded fastener body 19. It is understood that the sizing of the first and second body bores 13 and 14 permits such rocking of the first and second body plates 11 and 12 relative to the fastener body 19.

Figure 8:
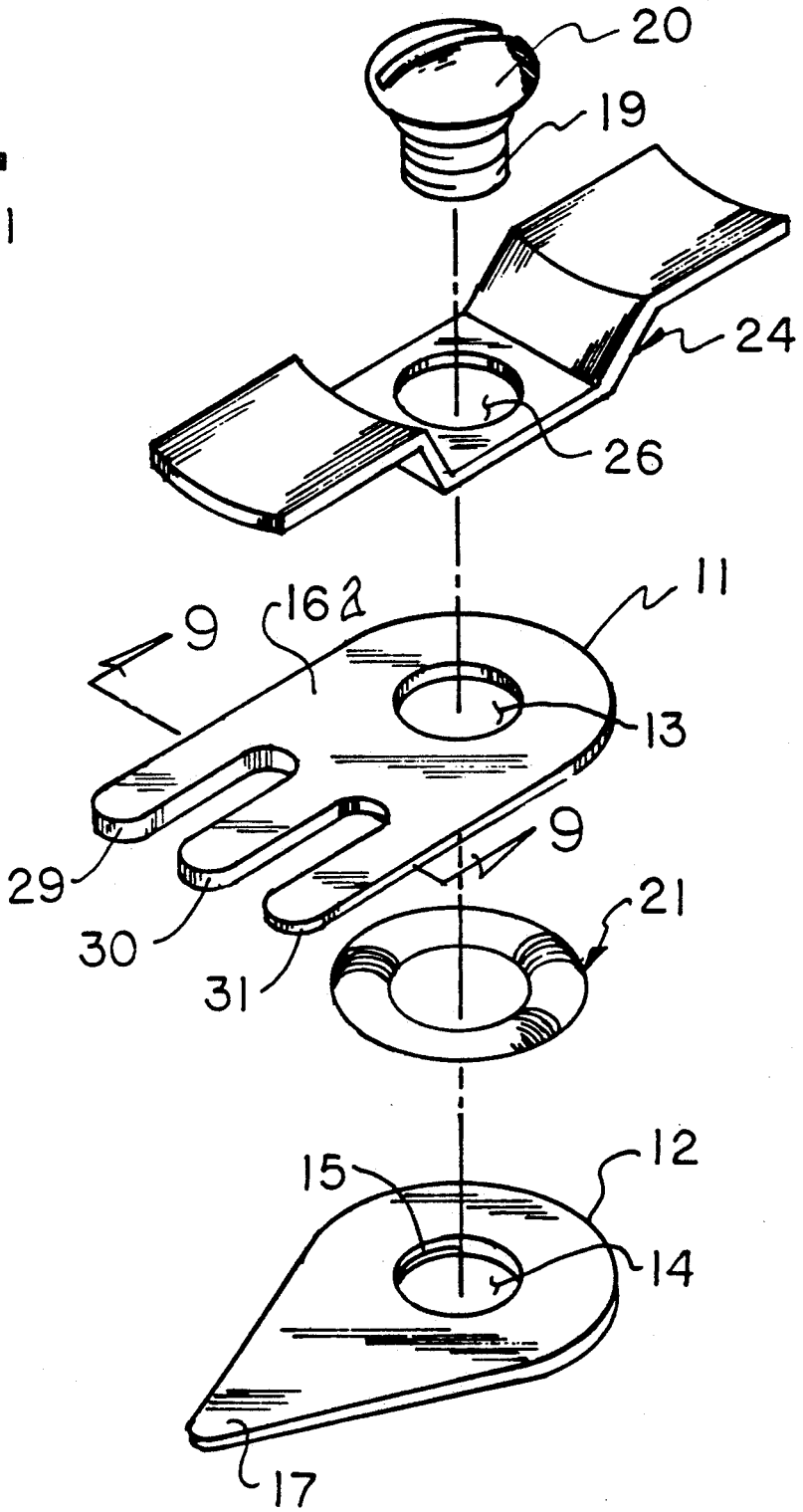
FIG. 8 is an isometric illustration of the invention utilizing a first body having spaced fingers of varying thicknesses.

The FIG. 8 indicates the use of a modified first body striking projection portion 16*a* having respective first, second, and third striking fingers 29, 30, and 31 arranged parallel relative to one another overlying the second body striking position 17. The first striking finger 29 is of a first thickness greater than the second thickness of the second striking finger 30, that in turn is of a greater thickness than a third thickness of the third striking finger 31. In this manner, the varying thicknesses of the fingers will further vary the audible residence of a stringed instrument in use of the organization.

It should be noted that the torroidal ring 21 may be also supplied in varying thicknesses to provide for initial spatial adjustment of the first plate body 11 relative to the second plate body 12.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A plectrum for a stringed instrument, comprising, a first body plate and a second body plate, the first body plate and the second body plate arranged in a spaced coextensive relationship relative to one another, with the first body plate having a first body striking projection coplanar with the first body plate extending therefrom, and a second body striking projection coplanar with the second body plate extending therefrom, with the first body plate having a first body bore, and the second body plate having a second body bore, wherein the first body bore and the second body bore are coaxially aligned, and fastening means for securing the first body plate and the second body plate, and wherein the fastening means includes an externally threaded fastener body, and a fastener head fixedly mounted to an upper distal end of the fastener body extending laterally of the first body bore having an internally threaded bore wall, and the internally threaded bore wall arranged for threaded interengagement with the fastener body, and a spacer ring receiving the fastener body therethrough positioned between the first body plate and the second body plate, and wherein the spacer ring is of a torroidal configuration and includes a resilient sheath torroidal tube having a tube cavity, and the tube cavity including a compressible fluid contained therewithin, and a lever plate, the lever plate including a central web, the central web including a central web bore positioned in contiguous communication to a top surface of the first body plate, and the central web bore coaxially aligned with the first body bore and the second body bore receiving the fastener body therethrough, and the lever plate having a forward lever flange and a rear lever flange that are diametrically aligned relative to one another on opposed sides of the central web bore, with the forward lever flange and the rear lever flange spaced above the central web, and the forward lever flange positioned over the first body striking projection and the second body striking projection, and the rear lever flange extending on a diametrically opposed side of the central web bore positioned over the first body plate and the second body plate.

2. A double plectrum as set forth in claim 1 wherein the first body striking projection includes a first striking finger, a second striking finger, and a third striking finger, with each striking finger arranged in a parallel relationship relative to one another, and the first striking finger of a first thickness, the second striking finger of a second thickness, and the third striking finger of a third thickness, wherein the first thickness is greater than the second thickness and the second thickness is greater than the third thickness.

* * * * *